United States Patent [19]

Johnson

[11] 4,431,389

[45] Feb. 14, 1984

[54] POWER TRANSMISSION

[75] Inventor: Harry T. Johnson, Troy, Mich.

[73] Assignee: Vickers, Incorporated, Troy, Mich.

[21] Appl. No.: 275,948

[22] Filed: Jun. 22, 1981

[51] Int. Cl.[3] ..... F04C 15/00

[52] U.S. Cl. ..... 418/82; 418/268

[58] Field of Search ..... 418/78, 81, 82, 267, 418/268, 269

[56] References Cited

U.S. PATENT DOCUMENTS

| | | | |
|---|---|---|---|
| 2,622,538 | 12/1952 | Vincent | 418/268 |
| 3,421,413 | 1/1969 | Adams | 418/82 |
| 3,451,346 | 6/1969 | Pettibone | 418/268 |

*Primary Examiner*—Leonard E. Smith
*Assistant Examiner*—Jane E. Obee
*Attorney, Agent, or Firm*—Barnes, Kisselle, Raisch, Choate, Whittemore & Hulbert

[57] ABSTRACT

A fluid pressure energy translating device of the sliding vane type comprising a cam ring including an internal contour, a rotor having a plurality of vanes rotatable therewith and slidable relative thereto in slots in the rotor with one end of each vane engaging the internal contour. The rotor and internal contour cooperate to define one or more pumping chambers between the periphery of the rotor and the cam contour through which the vanes pass carrying fluid from an inlet port to an outlet port. At least one cheek plate is associated with the body and rotor. Two pressure chambers are formed for each vane and each vane has two surfaces, one in each chamber, both being effective under pressure in the respective chambers to urge the vanes into engagement with the cam. A generally annular internal feed passage is formed entirely within the rotor and communicates with one set of the pressure chambers. A radial passage is provided along at least one side of each vane extending from the tip to the base thereof, so that cyclically changing pressure is supplied to the other set of chambers. An arcuate valving groove is formed in a cheek plate alongside the rotor in a high pressure zone. The annular groove communicates with the radial passage and axial openings in the rotor extend from a side of the rotor to the annular passage and are adapted to register with the arcuate valving groove as the rotor rotates relative to the cheek plate so that high pressure is applied to the one set of chambers.

10 Claims, 8 Drawing Figures

11a
29
22
22a
27
45a
45
15
10
26
77
13
18
12
44
46
40
36
25
38
37
39
2
7
4
8
45
45a
28
16
14
19
11
11b

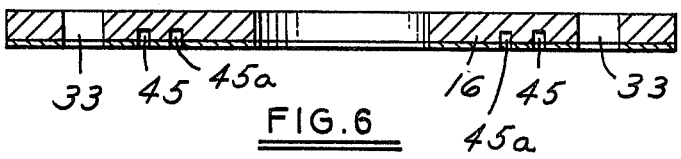
FIG. 6
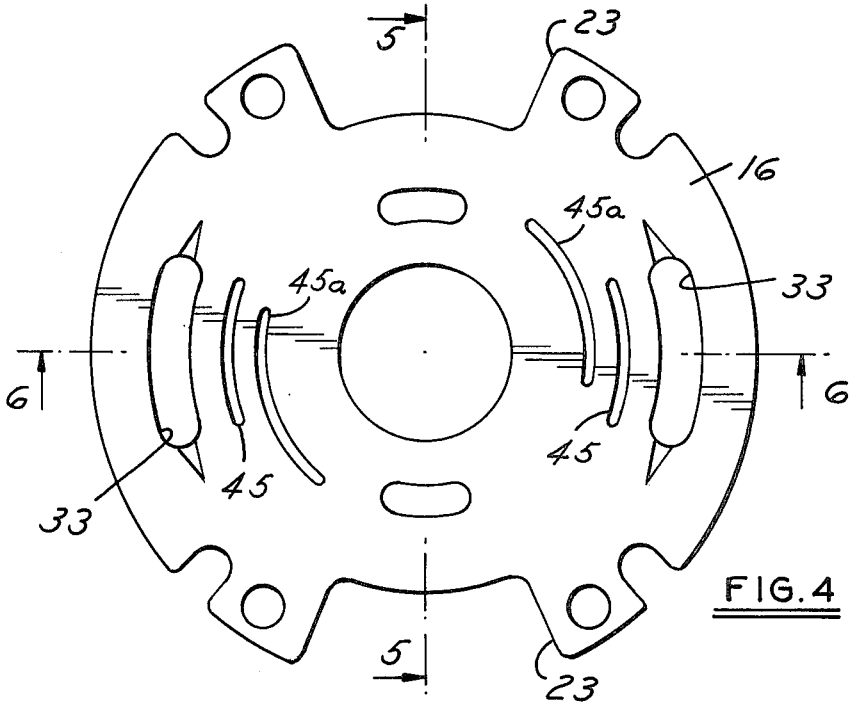
FIG. 4
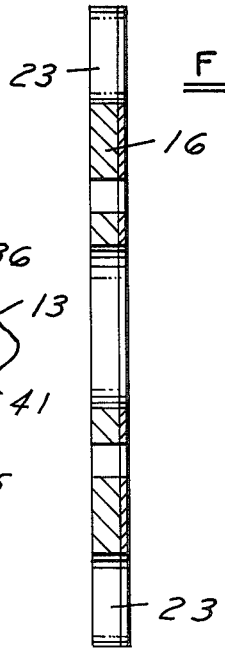
FIG. 5
FIG. 7
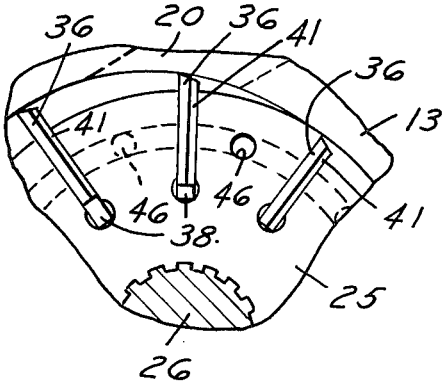

POWER TRANSMISSION

This invention relates to power transmissions and particularly to fluid pressure energy translating devices such as pumps or motors.

BACKGROUND AND SUMMARY OF THE INVENTION

A form of pump and motor utilized in hydraulic power transmission comprises a rotor having a plurality of spaced radial vanes rotatable therewith and slidable relative thereto in slots provided in the rotor. The rotor and vanes cooperate with the internal contour of a cam to define one or more pumping chambers between the outer periphery of the rotor and the cam contour through which the vanes pass carrying fluid from an inlet port to an inlet port. Cheek plates are associated with each side of the cam and rotor through which the fluid flows to and from the rotor.

It has heretofore been recognized that it is essential for efficient operation of the pump to apply pressure to a chamber at the underside of the vanes in order to maintain them in contact with the cam. In the past pressure has been applied continuously or intermittently to the undersides of the vanes. In the continuous pressure arrangement pressure is applied even when the vanes are in low pressure zones and has resulted in excessive cam and vane tip wear. In the intermittent pressure arrangement, pressure is applied to the vanes only when the vanes are in high pressure zones and only centrifugal force is utilized to urge the vanes toward the cam when the vanes are in low pressure zones. As a result the contact of the vanes with the cam is not positive during some portions of the travel so that efficiency is adversely affected.

It has heretofore been suggested and commercial devices have been made wherein additional pressure chambers are associated with each vane. The chamber at the base of each vane is commonly known as the under vane chamber and is subjected to cyclically changing pressure. The additional chambers are commonly known as the intra-vane chambers and are subjected to continuous high pressure. Typical devices are shown in U.S. Pat. Nos. 2,919,651 and 2,967,488. In such an arrangement, the contact of the vanes with the cam is controlled at all times by fluid pressure to the intra-vane and under vane chambers.

In order to feed high pressure fluid to the intra-vane or high pressure chamber, it has been necessary to utilize passages in the cheek plates in the zones of low pressure and axial grooves in the rotor intersecting with the vane slots. Since the fluid in these passages and grooves is at a high pressure, the fluid tends to leak through the interface between the cheek plates and rotor to the low pressure zones. In addition, leakage from the axial groove in the rotor to the under vane chamber may occur between the vanes and slots due to the tilting of the vane in the slot by the forces acting on the vane in a tangential direction.

In order to supply cyclically changing fluid pressure to the under vane chambers from the pumping chambers the rotor is formed with radial holes extending from the periphery of the rotor between the vane slots and intersecting the under vane chamber. However, with devices of this general type the radial holes in the rotor tend to weaken the rotor at the intersection of the radial hole and the under vane chamber. As a result it has been necessary to limit the maximum pump pressure to avoid rotor failure.

It has heretofore been suggested that the intra-vane chambers be fed with fluid through an internal passage formed entirely within the rotor and that a check valve be associated with each vane to control the flow of fluid to the chambers. A typical arrangement of this type is shown in U.S. Pat. No. 3,223,044.

The present invention is directed to a fluid pressure energy translating device which has increased efficiency and is easier and less costly to manufacture.

In accordance with the invention, a generally annular internal feed passage is formed entirely within the rotor and communicates with the intra-vane chambers. A radial passage along each side of each vane extends from the outer end or tip of each vane to the inner end or base of each vane thereof to supply cyclically changing fluid pressure to the under vane chambers. An arcuate valving groove is formed in each cheek plate alongside the rotor in the high pressure zones and communicates with the radial passages as the rotor rotates. Axial openings in the sides of the rotor extend to and intersect the annular passage. The axial openings are adapted to register with the arcuate groove as the rotor rotates relative to the cheek plates to supply fluid under pressure from the radial passages in the vanes through the arcuate grooves and axial openings to the annular passage and, in turn, to the intra-vane chambers.

DESCRIPTION OF THE DRAWINGS

FIG. 4 is a view of a cheek plate of the pump taken along the line 4—4 in FIG. 1.

FIG. 5 is a sectional view taken along the line 5—5 in FIG. 4.

FIG. 6 is a sectional view taken along the line 6—6 in FIG. 4.

FIG. 7 is a fragmentary view of a portion of the pump taken along the line 7—7 in FIG. 1.

DESCRIPTION

Figure 1:
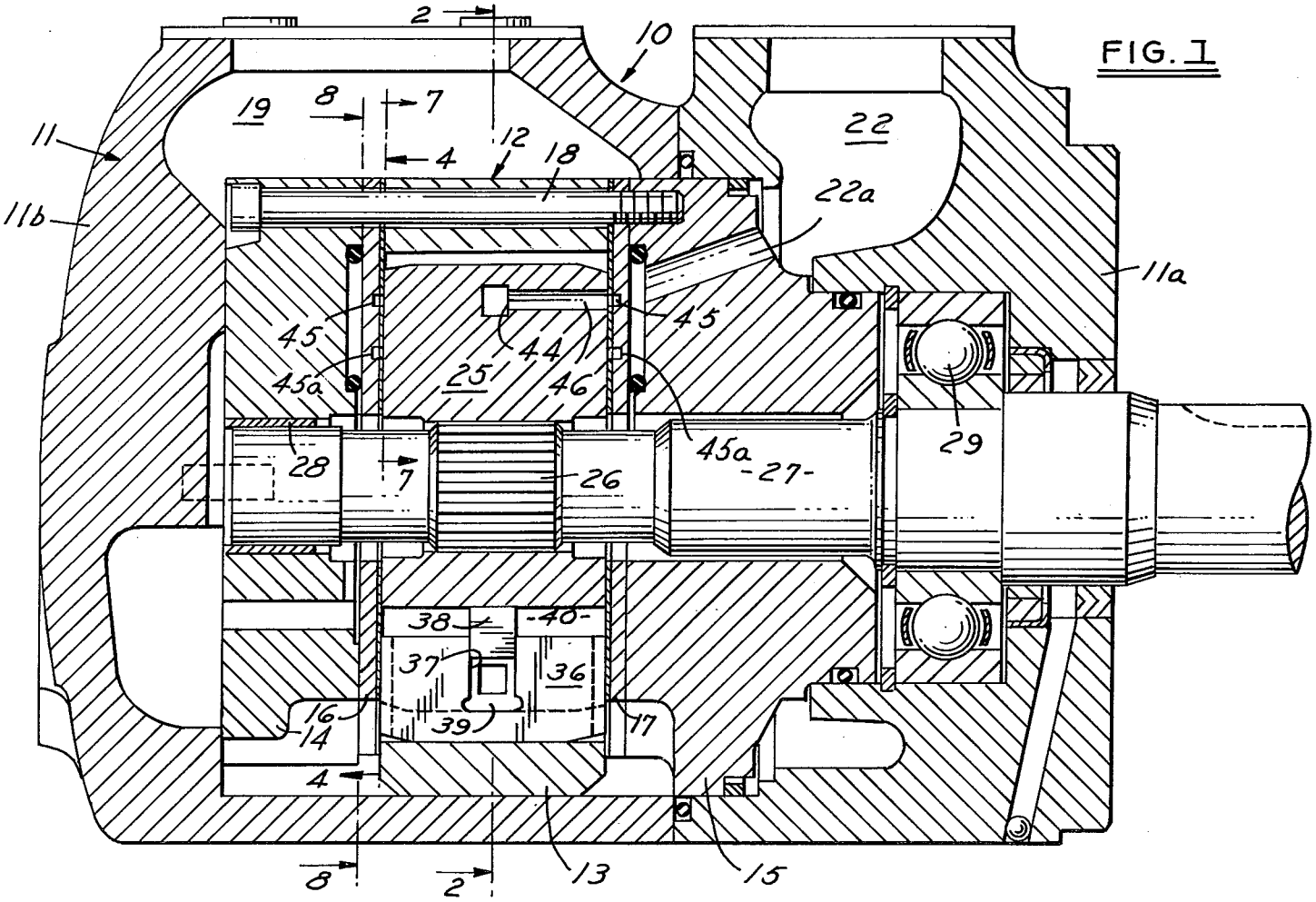
FIG. 1 is a longitudinal sectional view through a pump embodying the invention taken along the line 1—1 in FIG. 2.
Figure 2:
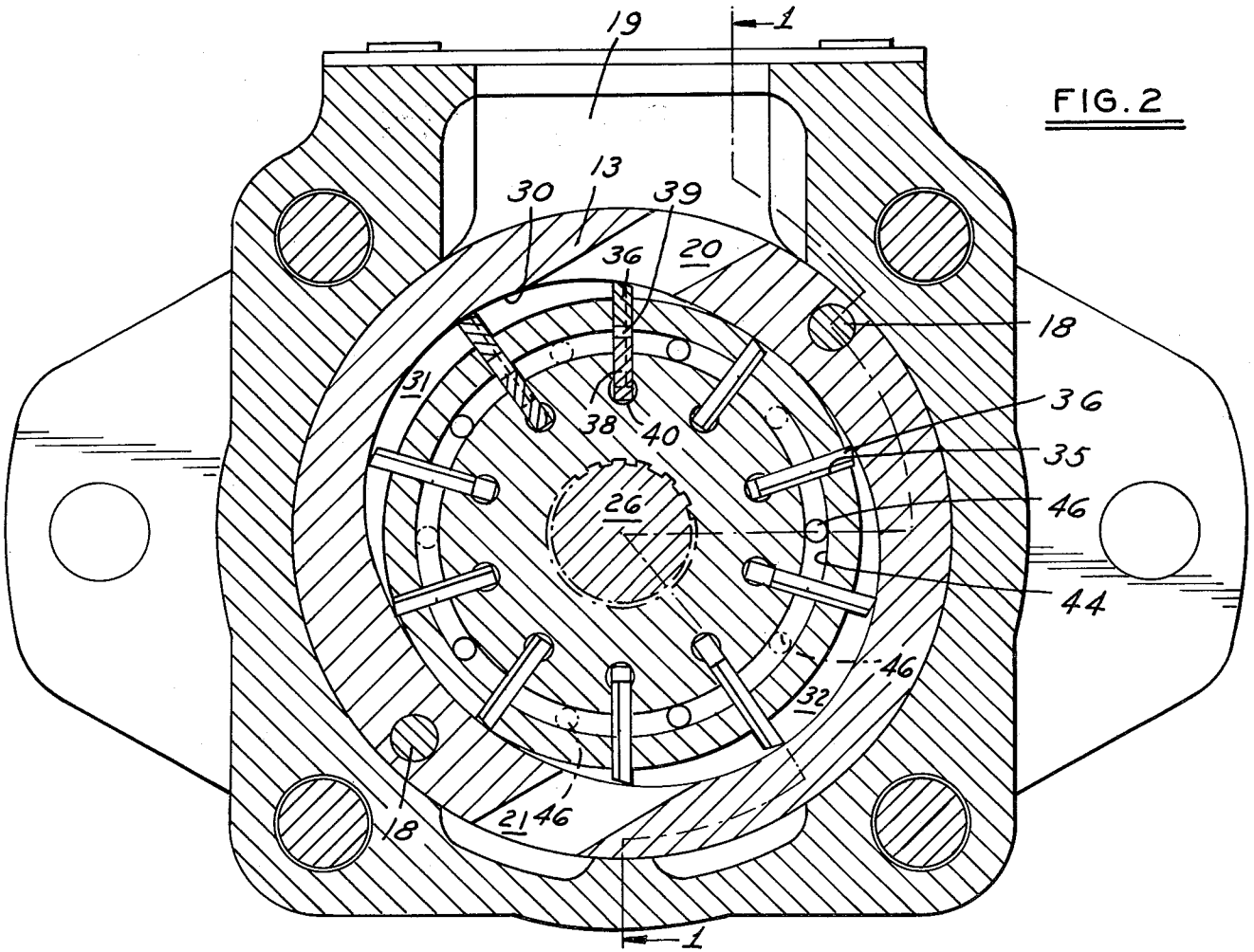
FIG. 2 is a sectional view taken along the line 2—2 in FIG. 1.
Figure 3:
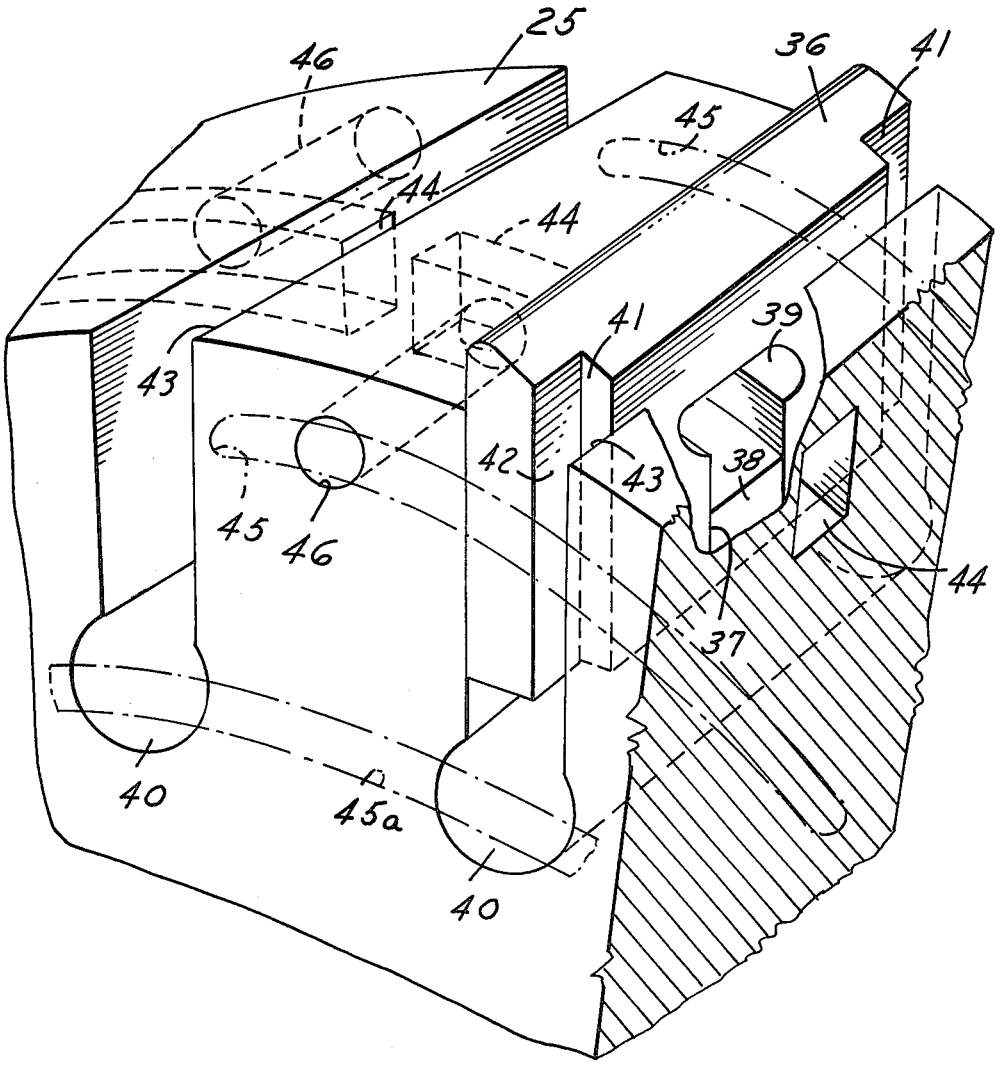
FIG. 3 is a fragmentary perspective view of a portion of a pump embodying the invention.
Figure 8:
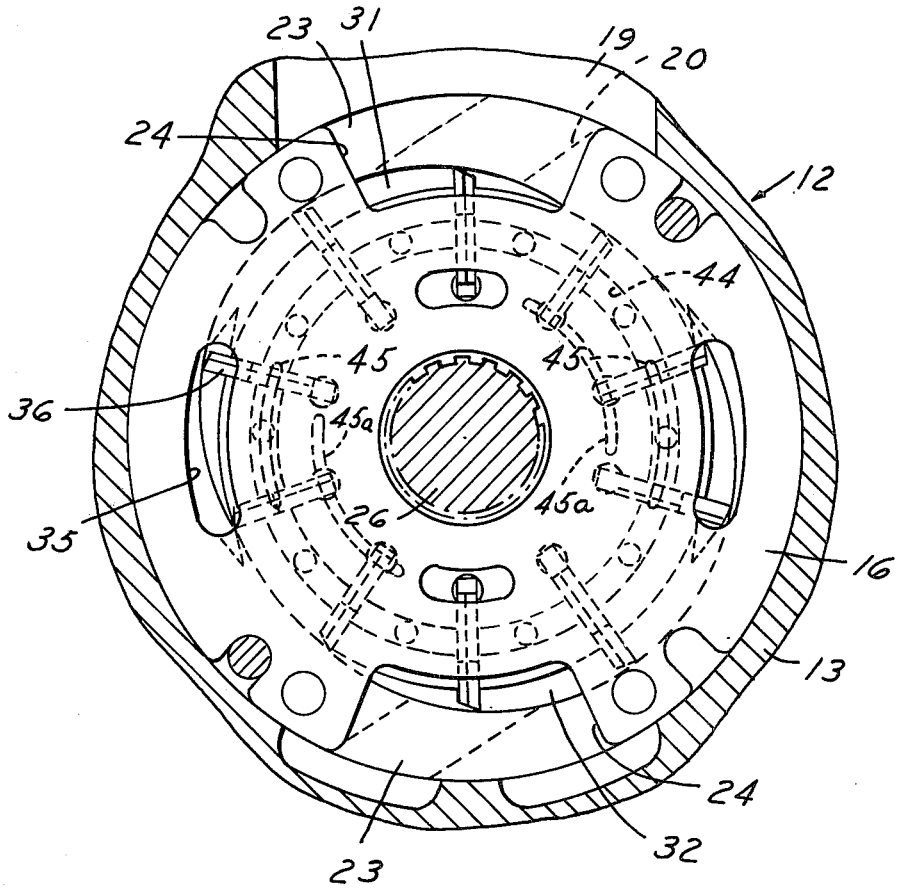
FIG. 8 is a fragmentary sectional view taken along the line 8—8 in FIG. 1.

Referring to FIGS. 1, 2, 6 and 8, there is shown a rotary sliding vane device or pump 10 comprising a casing 11 and a cartridge or subassembly 12. Casing 11 comprises a body **11*a* and a cover 11*b*. The cartridge 12 includes a cam ring 13 sandwiched between support plates 14, 15 with intermediate cheek plates 16, 17 all of which are secured to each other by bolts 18 extending through support plate 14 and cam 13 into threaded holes in support plate 15. The cover 11*b* is provided with an inlet supply connection port 19 leading into a pair of fluid port inlet openings 20, 21 in cam 13 as shown in FIG. 2 and passages 23 formed by recesses 24 in the cheek plates as shown in FIG. 8**.

An outlet connection port 22 is provided in the body **11*a* which is directly connected by a passage 22*a* to a pressure delivery chamber formed in support plate 15**.

A rotor 25 is rotatably mounted within the cam 13 on the splined portion 26 of a shaft 27 which is rotatably mounted within a bearing 28 in the support plate 14 and a bearing 29 mounted within the body 11*a*.

Cam 13 has an internal contour 30 which is substantially oval in shape and which together with the periphery of the rotor 25 and the adjoining surfaces of the cheek plates 16, 17 define two opposed pumping chambers 31, 32 each of which has fluid inlet and fluid outlet zones. The fluid inlet zones comprise those portions of the pumping chambers 31, 32, respectively, registering with the fluid inlet port openings 20, 21 and cheek plate passages 23. The fluid delivery zones comprise those portions of the pumping chambers 31, 32 registering, respectively, with opposed arcuately shaped fluid delivery port openings 33 in cheek plates 16, 17 which are directly connected to the outlet connection port 22. Fluid flows to the inlet zones through inlet port openings 20, 21 and also through the passages 23 formed by recesses 24 in the cheek plates 16, 17 which permit the fluid to flow from the inlet 19 between the sides of cam 13 and the respective supporting plates 14, 15 (FIG. 8).

The pumping device so far described is of the well known structure disclosed in the U.S. Pat. No. 2,967,488. It has been the practice in devices of this type to provide the rotor with a plurality of radial vane slots 35, each of which has a vane 36 slidably mounted therein. The outer end or vane tip of vanes 36 engage the inner contour of cam 13. The contour of cam 13 includes an inlet rise portion, an intermediate arc portion, an outlet fall portion, and another arc portion. The cam contour is symmetrical about its minor axis, thus each of the rise, fall and arc portions are duplicated in the other opposed portion of the contour. As the tips of vanes 36 carried by the rotor 25 traverse the inlet rise portions, the vanes 36 move radially outward with respect to the rotor 25, and when the vane tips traverse the outlet fall portions, the vanes 36 move radially inward. The spacing between each pair of vanes 36 is adapted to span the distance between each pair of ports in a manner to provide proper sealing between the inlet and outlet chambers of the pumping device.

Each vane 36 has a rectangular notch 37 extending from the inner end or base of the vane to substantially the mid-section thereof. A reaction member 38 comprises a flat sided blade substantially equal in width and thickness to that of the notch 37 in the vane so as to have a sliding fit within the vane and the side walls of each rotr vane slot 35. The side walls of the rotor vane slot 35, the vane 36 and the reaction member 38 define an expansible intra-vane chamber 39. An under vane pressure chamber 40 is defined by the base of each vane 36 and the base and side walls of each rotor vane slot 35. Chambers 39 and 40 are separated by and sealed from each other by reaction member 38. Thus, the two chambers 39, 40 are provided substantially the same as shown in United States Patent 2,967,488 which is incorporated herein by reference.

The under vane chamber 40, associated with the base of each vane 36, is provided with fluid pressure by radial passages 41 along each side of each vane 36. Passage 41 is defined by a groove 42 formed in each end of the vane, by a surface 43 of the rotor vane slot 35, and by the surface of cheek plates 16, 17. The radial passages 41 transmit fluid to the under vane chambers 40 and, thus, to the bases of the vanes 36. Thus, the cyclically changing pressure which is exerted on the tips of the vanes 36 as they traverse the inlet and outlet portions of the cam contour is transmitted to the bases of the vanes 36.

An annular closed passage 44 entirely within rotor 25 provides communication between the intra-vane chambers 39. Axial openings 46 formed in the side of the rotor 25 extend to and intersect with the annular passage 44. Fluid under pressure from radial passages 41 is supplied to the passage 44 by an arcuate valving groove 45 in each face of each cheek plate 16, 17. The groove 45 extends about a portion of the travel of rotor 25 in the outlet fall or high pressure zone. As the rotor 25 rotates, radial passage 41 communicates through arcuate groove 45 with axial openings 46 consequently with annular passage 44. Since the vanes 36 are moving radially inward in the outlet fall zone, the vanes 36 displace fluid in the under vane chamber 40 through the restriction provided by the radial passages 41. An elevated fluid pressure gradient is thereby produced in the radial passages 41. As the radial passages 41 move across the arcuate grooves 45 the elevated fluid pressure is transmitted to the intra-vane chambers 40 through the axial openings 46 and the annular passage 44. The elevated fluid pressure is also continuously transmitted to the intra-vane chambers 39 and acts to move the vanes 36 radially outward and hold the reaction members 38 against the base of the under vane chamber 40.

The dimensions of each radial passage 41 are such that the fluid is throttled in flowing from the chamber 40. As a result the pressure in chamber 40 is greater than the pressure in the outlet zone pumping chamber and the pressure in the grooves 45 and, in turn, to the annular passage 44 is at a pressure greater than the pressure in the outlet zone pumping chamber. As a result, the forces on the vanes will assure that the vanes are maintained in contact with the cam contour while in the high pressure or outlet fall zone.

It has been found that in pump applications involving relatively low speeds, for example 600 revolutions per minute, that poor sealing contact is experienced between the tip of the vane and the inner contour of the cam as the vane travels through the intermediate arc or sealing zone of the cam. The sealing zone is that portion of the vane travel between the high pressure outlet or discharge zone and the low pressure inlet zone of the pump. It is believed that the loss of sealing contact of the tip is the result of lower contrifugal forces acting on the vane combined with degradation of fluid pressure in the under vane chamber of the involved vane.

Inasmuch as the vane traveling through the sealing zone is stationary in the radial direction, that is the vane is traveling through a dwell in the cam contour, in higher speed applications centrifugal force and the high pressure serve to maintain the tip of the vane in contact with the cam. However, at low speeds it is believed that the reduced centrifugal force and the increased time interval that it takes for the involved vane to travel through the sealing zone leads to increased leakage from the under vane chamber to the low pressure zone existing in the bore around the rotor drive shaft tending to degrade the fluid pressure in the under vane chamber.

In such applications it is desirable to supply additional high pressure fluid to the involved under vane chamber as a means of maintaining the tip of the vane in sealing contact with the cam. To this end the pump is provided with an additional pair of arcuate grooves 45*a* in the cheek plates 16, 17. The arcuate grooves 45*a* are positioned radially inward of arcuate grooves 45 so as to be intercepted by and in communication with the under vane chambers 40 as the rotor rotates. The arcuate grooves 45*a* span an arc leading from the outlet fall zone of the cam through the sealing zone just short of the inlet rise zone of the cam, thereby transmitting an additional supply of high pressure fluid to the under vane chambers as they travel through the sealing zone.

As shown in FIG. 7, each radial passage 41 has its outer end terminating radially inwardly of the tip of the vane 36. In other words, the radial passage 41 does not intersect or affect the seal at the tip. Although the vanes 36 are shown with the tips leading with respect to the direction of rotation and the radial passages 41 trailing, the vanes 36 may be inserted in the vane slots so that the tips are trailing with respect to the direction of rotation in which case the radial passages would be leading.

Axial openings 46 preferably extend inwardly in alternate fashion from opposite sides of alternate segments of the rotor as shown in FIGS. 1, 2 and 7, a segment being that portion of the rotor between vane slots 35. This facilitates manufacture of the rotor since it is easier to form openings 46 part way through the rotor. In addition, the opposite positioning of the axial openings 46 from opposite sides of the rotor provides a better pressure balance on the rotor. However, it has been found that satisfactory operation will also occur if the axial openings 46 extend entirely through the rotor or from one side only of the rotor.

By providing axial openings that extend alternately from a side of the rotor to the annular passage, the flow of fluid in the annular passage is in two directions circumferentially. This insures that there are no flow restrictions in the annular passage which might impede flow from the axial openings to the intra-vane chambers. Providing two paths of flow avoids the necessity of fluid flow across a juncture of the annular passage and the intra-vane chamber of a vane when the vane is in a radial inward position.

Since the valving grooves 45 are in the high pressure or outlet fall zones, leakage due to a pressure differential at the interface between the cheek plates and rotor is obviated. Since there is no axial groove in the rotor vane slots to feed the intra-vane chambers, leakage from such a groove to the under vane chambers, when the under vane chambers are at low pressure, is obviated. Since the leakage is obviated, the erosion due to leakage of contaminated fluid is also obviated.

In addition, since flow through radial passages 41 to the under vane chambers occurs from the sides of the vanes axially toward the middle of the vanes, in a transition zone from low pressure to high pressure, gas erosion due to cavitation on the cheek plates, which are normally made of a softer metal such as bronze, is obviated.

It has been found that in low pressure conditions, a single radial passage 41 will provide satisfactory operation.

Although the use of valving grooves 45 on each cheek plate is preferred, satisfactory results may be achieved by the use of a valving groove on only one cheek plate so that axial openings would be provided only on one side of the rotor to supply fluid from the groove to the annular passage.

Satisfactory operation can be achieved if the axial openings 46 are positioned in alternate segments between the vanes rather than in each segment.

Although the invention has been described as used in a pump, it can also be used in a motor of the sliding vane type.

What is claimed is:

1. A fluid pressure energy translating device of the sliding vane type comprising a cam body including an internal contour, a rotor, a plurality of vanes rotatable with said rotor and slidable relative thereto in slots in the rotor, one end of each vane engaging said internal contour, said rotor and internal contour cooperating to define one or more pumping chambers between the periphery of the rotor and the cam contour through which the vanes pass carrying fluid from an inlet port to an outlet port, at least one cheek plate associated with said body and rotor and having a delivery port opening, means forming two pressure chambers for each vane, each vane having two surfaces, one in each chamber, both being effective under pressure in said respective chambers to urge the vanes into engagement with the internal contour, a generally annular internal feed passage formed entirely within said rotor communicating with one set of said pressure chambers, each of said vane having inner and outer ends and sides, the inner end of each said vane defining the surface of one of said pressure chambers, a radial passage along at least one side of each said vane extending from the inner to the outer ends thereof, said passage being defined by surfaces of the vane, rotor and a cheek plate, an arcuate valving groove formed in a cheek plate in an outlet fall zone or high pressure zone alongside said rotor and in communication with said radial passage and isolated from said delivery port opening, axial openings in said rotor extending from a side of said rotor to said annular passage and adapted to register with said arcuate valving groove as the rotor rotates relative to said cam body such that as the rotor rotates, said radial passages of said vanes communicate through said arcuate valving groove with said axial openings, and, in turn, said annular feed passage, and as said vanes are moved radially inward in said outlet fall zone, said vanes displace fluid in the chamber associated with the inner end of each said vane through the restriction provided by the associated radial passage transmitting fluid at an elevated fluid pressure to said one set of pressure chambers through said annular feed passage, said axial openings associated with said groove and said annular internal feed passage.

2. The fluid pressure energy translating device set forth in claim 1 wherein said radial passage is defined by a groove in the end of said vane, by a surface of the rotor vane slot and by a surface of the cheek plate.

3. The fluid pressure energy translating device set forth in claim 2 wherein the outer end of said radial passage extends to an area spaced from radially inwardly from the tip of each vane.

4. The fluid pressure energy translating device set forth in claim 2 wherein a radial passage is provided at each end of each said vane.

5. The fluid energy translating device set forth in claim 1 wherein an additional arcuate valving groove is provided in a cheek plate positioned along the other side of said rotor communicating with a second set of radial passages in the vanes.

and additional axial openings in said rotor extending from the other side of said rotor to said annular passage and adapted to communicate with said second arcuate groove as the rotor rotates.

6. The fluid energy translating device set forth in claim 5 wherein said axial openings extend alternately from each side of said rotor to said annular passage.

7. The fluid energy translating device set forth in claim 5 wherein said axial openings comprise a plurality of single opening extending entirely through said rotor.

8. The fluid energy translating device set forth in claim 7 wherein said axial openings in said rotor are provided at selected predetermined spacing in said rotor.

9. The fluid energy translating device according to claims 1 or 5 including a second arcuate valving groove formed in a cheek plate adapted to communicate with said chambers associated with the inner end of each said vane.

10. The fluid energy translating device set forth in claim 9 wherein said second arcuate valving groove spans an arc leading from the outlet fall zone through the sealing zone just short of the inlet rise zone thereby transmitting an additional supply of high pressure fluid to a set of said chambers associated with the inner end of each said vane as said chambers travel through the sealing zone.

* * * * *